US008646809B2

(12) United States Patent
Lee

(10) Patent No.: US 8,646,809 B2
(45) Date of Patent: Feb. 11, 2014

(54) LENGTH ADJUSTABLE SKATE BLADE GUARD

(71) Applicant: Chang Ju Lee, Anyang (KR)

(72) Inventor: Chang Ju Lee, Anyang (KR)

( * ) Notice: Subject to any disclaimer, the term of this patent is extended or adjusted under 35 U.S.C. 154(b) by 0 days.

(21) Appl. No.: 13/646,743

(22) Filed: Oct. 8, 2012

(65) Prior Publication Data

US 2013/0264811 A1 Oct. 10, 2013

(30) Foreign Application Priority Data

Apr. 5, 2012 (KR) ..... 10-2012-0035422

(51) Int. Cl.
*A63C 3/12* (2006.01)

(52) U.S. Cl.
USPC ..... 280/825; 280/7.13; 280/811

(58) Field of Classification Search
USPC ..... 280/7.13, 7.14, 11.18, 811, 809, 845, 280/825
See application file for complete search history.

(56) References Cited

U.S. PATENT DOCUMENTS

| | | | | |
|---|---|---|---|---|
| 1,788,433 | A * | 1/1931 | Johnson | 280/825 |
| 3,015,492 | A * | 1/1962 | Kesner et al. | 280/825 |
| 3,135,526 | A * | 6/1964 | Johns | 280/825 |
| 4,252,345 | A * | 2/1981 | Cabral | 280/825 |
| 4,382,615 | A * | 5/1983 | Gronborg et al. | 280/825 |
| 4,392,674 | A * | 7/1983 | Evon | 280/825 |
| 5,513,881 | A * | 5/1996 | DiMeglio et al. | 280/825 |
| 5,573,275 | A * | 11/1996 | Smith et al. | 280/825 |
| 5,642,928 | A * | 7/1997 | Hylton | 362/545 |
| 5,941,568 | A * | 8/1999 | White, II | 280/825 |
| 6,000,721 | A * | 12/1999 | Pfaeffle | 280/809 |
| 6,142,528 | A * | 11/2000 | Riley | 280/825 |
| 6,916,046 | B2 * | 7/2005 | Riley et al. | 280/825 |
| 7,673,884 | B2 * | 3/2010 | Wuerthner | 280/11.18 |
| 7,866,705 | B2 * | 1/2011 | Mayer et al. | 280/825 |
| 2012/0030862 | A1 * | 2/2012 | Swanson | 2/239 |

FOREIGN PATENT DOCUMENTS

| | | |
|---|---|---|
| KR | 20-0395811 | 9/2005 |

* cited by examiner

*Primary Examiner* — Hau Phan
(74) *Attorney, Agent, or Firm* — Park, Kim & Suh, LLC

(57) ABSTRACT

Disclosed herein is a length adjustable skate blade guard. The blade guard includes a first guard surrounding at least portion of a lower surface of a skate blade and a front end of the skate blade. A second guard surrounds a remaining portion of the lower surface of the skate blade and a rear end of the skate blade. At least one extension block is coupled between the first guard and the second guard, and extends a length of the guard to correspond to a length of the skate blade. At least one elastic body is secured at opposite ends thereof to the first guard and the second guard, respectively, the elastic body elastically putting the facing first and second guards in close contact with each other.

14 Claims, 13 Drawing Sheets

(A)

(B)

(A)

(B)

(A)

(B)

LENGTH ADJUSTABLE SKATE BLADE GUARD

This application claims the benefit of Korean Patent Application No. 10-2012-0035422, filed on Apr. 5, 2012. The foregoing applications are incorporated by reference herein in their entireties.

FIELD OF THE INVENTION

The present invention relates generally to skate blade guards and, more particularly, to a length adjustable skate blade guard, which is configured so that an extension block is detachably provided between a pair of guards connected to each other by an elastic body, thus enabling the blade guard to fit closely against skate blades of various sizes merely by replacing the extension block with another one, and which further includes an ornament on a front end or a rear end of the guard, thus increasing the functionality of the guard.

DESCRIPTION OF THE RELATED ART

Generally, a skate blade guard serves to prevent a skate blade from being damaged due to external impacts or friction.

Such a skate blade guard is disclosed in Korean U.M. Registration No. 20-0395811, which is entitled "Blade Case for Skates". A key point of the conventional guard is to attach a reinforcing material such as Kevlar fiber to an outer surface of a bottom of a main body of the skate blade case, thus remarkably improving the durability of the bottom that may be split by a sharp skate blade.

That is, the conventional guard prevents damage to the skate blade, and improves the durability of the guard to prolong its usable period, thus reducing the cost of purchasing the skate blade case and minimizing the emotional as well as economical burden.

However, there is a limit to the application of the conventional skate blade case, namely the guard, to skates of various lengths. In order to cope with skate blades of various sizes, the guard must be manufactured in various sizes thus causing an economical burden.

Further, even if guards for various sizes of blades have been previously manufactured, if there is little or no demand for a guard of a particular size, it leads to an increase in stock and thus financial loss.

Furthermore, when the length of the guard does not match that of the skate blade, the length of the guard should be adjusted by cutting it to a desired length. However, the material of the guard is very hard, so that an additional tool must be used, thus inconveniencing a user.

Therefore, there is an urgent need to develop guards coping with skate blades of various sizes or lengths and preventing damage due to external impacts and friction, in addition to improving durability.

SUMMARY OF THE INVENTION

Accordingly, the present invention has been made keeping in mind the above problems occurring in the prior art, and an object of the present invention is to provide a length adjustable skate blade guard, which is configured so that an extension block of a preset length is coupled between a pair of guards, thus allowing the guard to be mounted to skate blades of various sizes, and facilitating the detachable coupling of the guard by means of an elastic body.

Another object of the present invention is to provide a length adjustable skate blade guard, which standardizes an extension block in various sizes, thus providing the convenience of selection to a purchaser, and enabling the customization of the guard.

A further object of the present invention is to provide a length adjustable skate blade guard, which further includes an ornament on at least one of a front end, a rear end and a side of the guard, thus offering functionality, i.e. allowing the guard to be more efficiently identified and providing a good appearance, therefore satisfying consumers' desires.

Yet another object of the present invention is to provide a length adjustable skate blade guard, which is implemented so that a fastening pin for fastening an elastic body is locked or unlocked by a locker, thus enabling the assembly and disassembly of the guard without using an additional tool, and eliminating the inconvenience of possessing the tool. In other words, in order to adjust the length of the guard, the additional tool for cutting a portion of the guard is not required, so that it is easy to adjust the length.

In order to accomplish the above objects, the present invention provides a length adjustable skate blade guard, including a first guard surrounding at least a portion of a lower surface of a skate blade and a front end of the skate blade; a second guard surrounding a remaining portion of the lower surface of the skate blade and a rear end of the skate blade; at least one extension block coupled between the first guard and the second guard, and extending a length of the guard to correspond to a length of the skate blade; and at least one elastic body secured at opposite ends thereof to the first guard and the second guard, respectively, the elastic body elastically putting the facing first and second guards in close contact with each other.

Preferably, each of the first and second guards may include a seating portion surrounding the skate blade; a receiving groove longitudinally provided in an outer portion thereof to receive the elastic body; and at least one or more fastening holes provided at regular intervals in a longitudinal direction of the receiving groove, with a fastening pin being fitted into a corresponding fastening hole to fasten the elastic body.

Preferably, the fastening pin may include a body having a length that corresponds to that of the fastening hole, a diameter of the body being smaller than or equal to that of the fastening hole; a head provided on an end of the body and having a larger diameter than the fastening hole, with the elastic body being supported between the head and the fastening hole; and a locker coupled to an opposite end of the body via a hinge, the locker locking the elastic body and preventing the body from being removed from the fastening hole.

Preferably, the fastening pin may include a body having a length that corresponds to that of the fastening hole, a diameter of the body being equal to or smaller than that of the fastening hole; a head provided on an end of the body and having a larger area than the fastening hole, with the elastic body being supported between the head and the fastening hole; and a locker provided on an opposite end of the body to be resiliently coupled to the fastening hole, thus preventing the body from being removed from the fastening hole.

Preferably, the locker may include a cut portion formed by cutting an end of the locker axially, the cut portion being larger than the diameter of the fastening hole; elastic pieces symmetrically provided on opposite sides of the cut portion; and a locking step formed between each of the elastic pieces and the body of the locker.

The head may be biased and protrudes with respect to the body serving as an axis, and may further include a protruding portion to support the elastic body between the head and the fastening hole.

Each of the elastic pieces may further include a reinforcing member formed to be sharp at an end thereof and reinforcing a thickness of a region of the elastic piece adjacent to the locking step.

Preferably, the seating portion may be in a form of a multistep to receive both the blade and a frame supporting the blade.

Preferably, the extension block may include the seating portion and the receiving groove extending therein, the receiving groove comprising a hole that has a shape corresponding to the elastic body.

Preferably, the guard may further include an ornament detachably attached to at least one of a front end of the guard surrounding the front end of the skate blade, a rear end of the guard surrounding the rear end of the skate blade, and both sides of the guard.

Preferably, the ornament may be any one of a light, a logo, initials, a name tag, and a character, or may be present as an indicator for indicating a coupling direction of the skate blade.

Preferably, the ornament may include an ornament head, with any one of the light, the logo, the initials, the name tag and the character being attached or served on the ornament head; and an ornament fastening member protruding from a surface of the ornament head, and detachably fastened to the fastening hole formed in the guard through press-fitting or resilient-fitting.

Preferably, the ornament fastening member may include an ornament body passing through the fastening hole; and an ornament resilient member provided on an end of the ornament body, and resiliently detachably fastened to the fastening hole.

Preferably, a lower surface of the first guard and the second guard, or of the first guard, the second guard and the extension block may be curved from an end to an opposite end thereof.

According to the configuration of the present invention, the following advantages can be expected.

The present invention is advantageously configured so that an extension block of a preset length is coupled between a pair of guards, thus allowing the guard to be mounted to skate blades of various sizes, and facilitating the detachable coupling of the guard by means of an elastic body.

The present invention advantageously standardizes an extension block in various sizes, thus providing the convenience of selection to a purchaser and enabling the customization of a guard.

Advantageously, the present invention further includes an ornament on at least one of a front end, a rear end and a side of a guard, thus offering functionality, i.e. allowing the guard to be more efficiently identified, and providing a good appearance, therefore satisfying consumers' desires.

The present invention is advantageously implemented so that a fastening pin for fastening an elastic body is locked or unlocked by a locker, thus enabling the assembly and disassembly of a guard without using an additional tool, and eliminating inconvenience of preparing or possessing the additional tool for artificially adjusting the length of the guard.

BRIEF DESCRIPTION OF THE DRAWINGS

The above and other objects, features and advantages of the present invention will be more clearly understood from the following detailed description taken in conjunction with the accompanying drawings, in which:

FIGS. 9A and 9B are sectional views illustrating an example of the guard in accordance with the preferred embodiment of the present invention, in which FIG. 9A depicts a case where one extension block is installed, and FIG. 9B depicts a case where two extension blocks are installed;

DESCRIPTION OF PREFERRED EMBODIMENTS

The preferred embodiment of a length adjustable skate blade guard according to the present invention will be described in detail with reference to the accompanying drawings. Further, to enhance clarity of description, familiar functions and constructions relating to the present invention will be omitted herein.

Terms used in the description of the present invention may be defined in the context of the function of the present invention. Since the terms may vary depending on the practice or intention of those skilled in the art, the definition thereof may be based on the entire specification.

Figure 1:
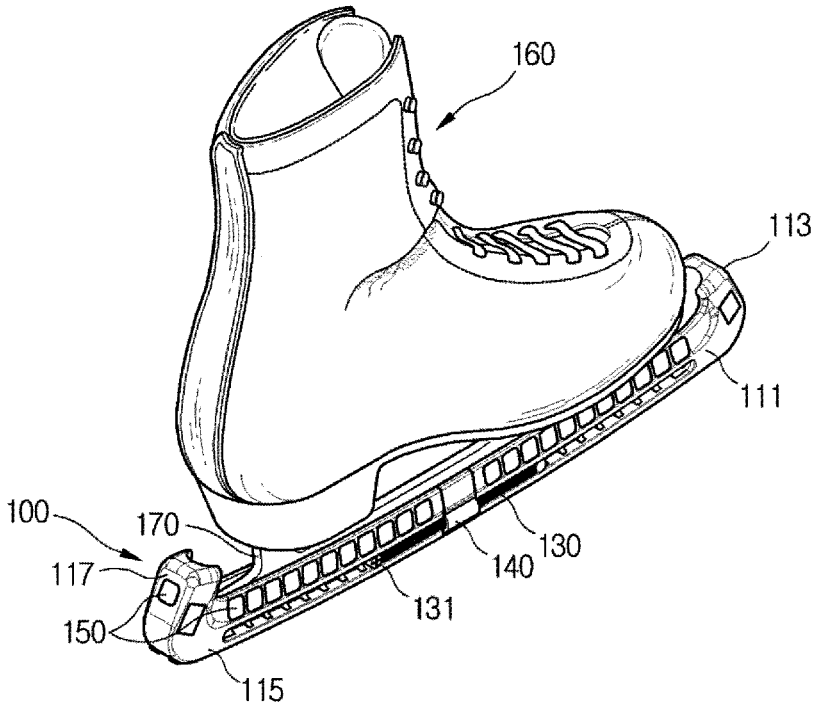
FIG. 1 is a perspective view illustrating a length adjustable skate blade guard in accordance with a preferred embodiment of the present invention.

FIG. 1 is a perspective view illustrating a length adjustable skate blade guard, in accordance with a preferred embodiment of the present invention.

As shown in the drawing, a skate blade guard 100 is used for ice skating, and serves to prevent a skate blade from being damaged by external impacts or friction.

Such a guard 100 includes a first guard 111 and a second guard 115 which are put in close contact with each other by elastic bodies 130. The first and second guards 111 and 115 may be elastically spaced apart from each other. Thus, it is easy to removably couple the guard 100 to a skate blade 170.

Further, when the length of the guard 100 is shorter than the skate blade 170, as shown in the drawing, the first and second guards 111 and 115 are spaced apart from each other, and then an extension block 140 is added in the space between the first and second guards 111 and 115, thus extending the guard 100 to a length corresponding to the length of the skate blade 170.

That is, the length of each of the first and second guards 111 and 115 is fixed to a single minimum size, and the length by which they are short is compensated for by the extension block 140, thus extending the guard 100 to the desired length.

Preferably, the length of the single minimum size is corresponds to a minimum length of the skate blade. For example, if the minimum length of the skate blade 170 is 200 mm, the single minimum size corresponding to this length is 200 mm, and if the length of the skate blade 170 is 200 mm or more, a shortness of the length of the guard is covered by the extension block 140.

Thus, the guard 100 may be extended to various lengths merely by adding the extension block 140 or replacing the extension block 140 with another one, thus matching skate blades 170 of various sizes.

Such a guard 100 will be described in detail with reference to FIGS. 2 to 6C.

Figure 2:
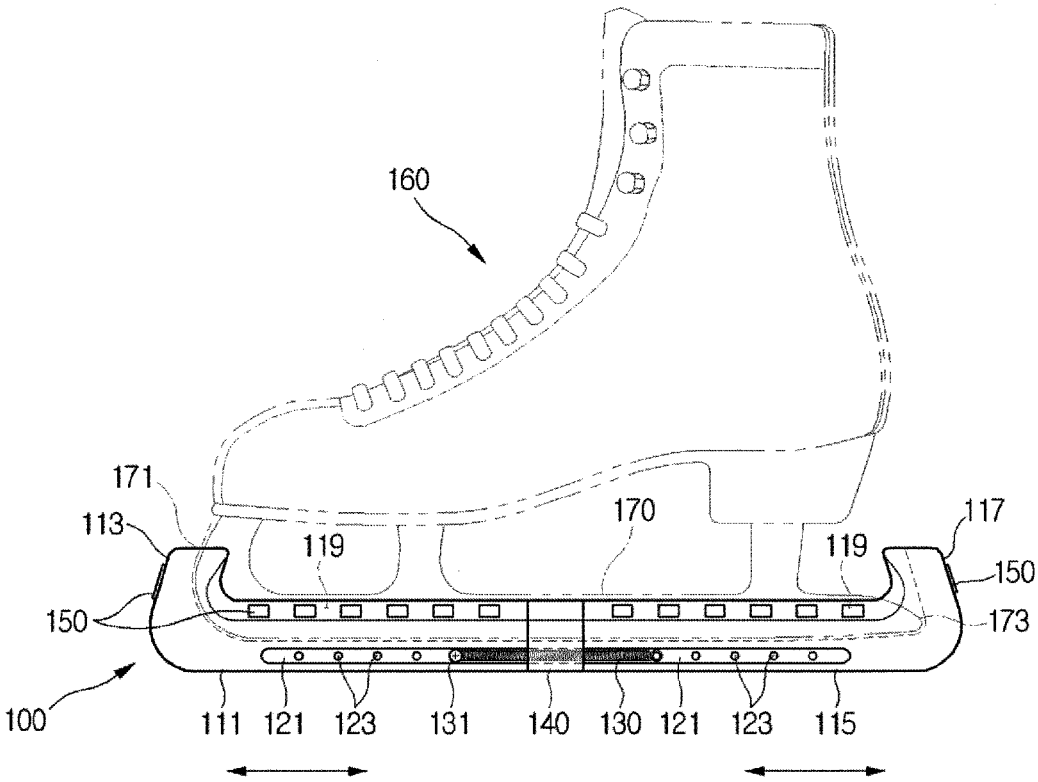
FIG. 2 is a side view illustrating the guard in accordance with the preferred embodiment of the present invention.
Figure 3:
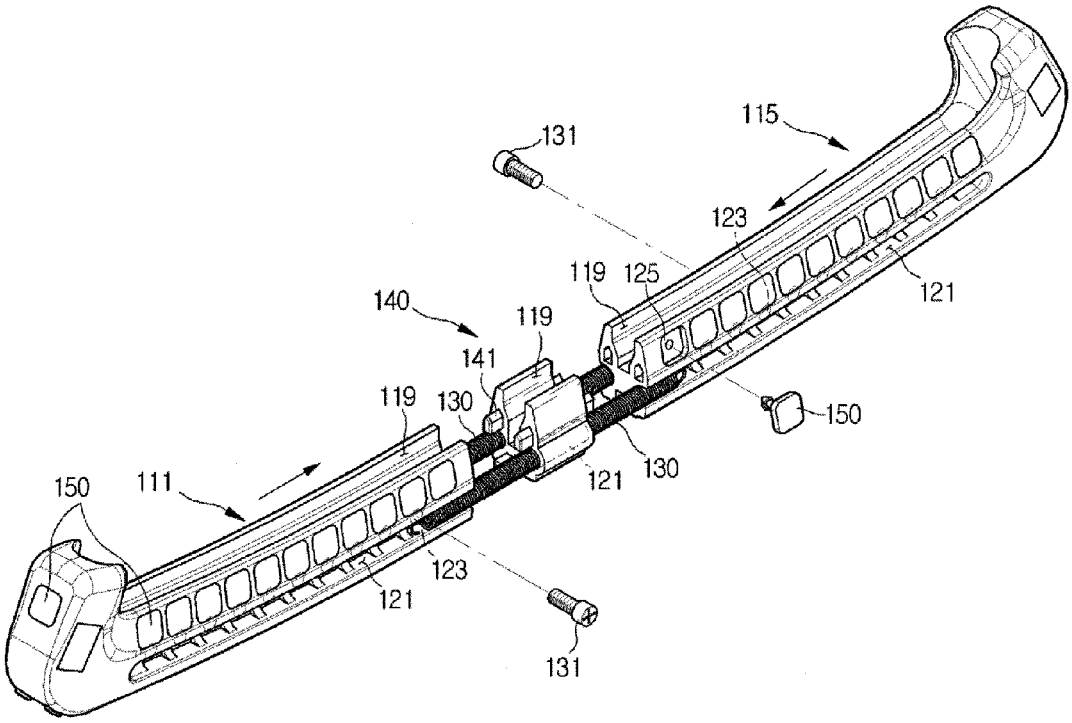
FIG. 3 is an exploded perspective view illustrating a fastening pin of the guard in accordance with a preferred embodiment of the present invention.

FIG. 2 is a side view illustrating the guard in accordance with the preferred embodiment of the present invention, FIG. 3 is an exploded perspective view illustrating D-1 in detail, and FIGS. 4A to 6C are views illustrating the fastening of a fastening pin.

As shown in FIG. 3, the guard 100 includes the first guard 111, the second guard 115, and the extension block 140 that are put in close contact with each other by the elastic bodies 130. Here, the first guard 111 and the second guard 115 are symmetrical with respect to each other. Since the first guard 111 and the second guard 115 are symmetric in terms of overall configuration except that a front end 113 and a rear end 117 are different from each other in height or length, only the first guard 111 will be described below.

The first guard 111 includes a seating portion 119, receiving grooves 121, and fastening holes 123. The seating portion 119 accommodates a portion of a lower surface of the skate blade 170 and a front end 171 thereof, and surrounds the skate blade 170. The receiving grooves 121 are used to couple the front end 113 for guarding the front end that protrudes forwards with the elastic bodies 130. The fastening holes 123 are used to fasten the elastic bodies 130 to predetermined positions. Here, the rear end 173 of the skate blade is guarded by the rear end 117 of the second guard 115.

As shown in the drawings, the seating portion 119 is a depression that supports both sides and a lower surface of the skate blade 170. The width of the seating portion 119 is preferably formed to be equal to or slightly wider than the skate blade.

Meanwhile, although not shown in the drawings, the surface of the seating portion 119 is preferably formed such that its open surface is curved or inclined so as to enable easy access to the skate blade 170. Of these shapes, the curved surface is particularly preferable.

Figure 10:
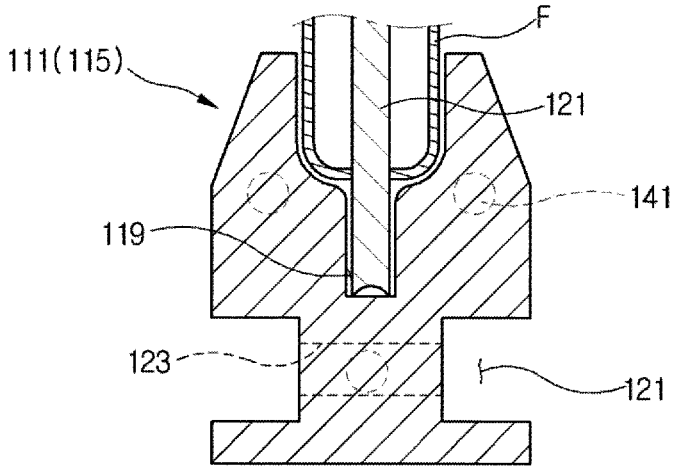
FIG. 10 is a sectional view showing a multistep seating depression in accordance with a preferred embodiment of the present invention.

Further, as shown in FIG. 10, the seating portion 119 may be shaped in multiple steps to accommodate both the blade 170 and a frame F supporting an outer portion of the blade 170.

That is, the seating portion 119 is present in the form of multiple steps so that the open surface corresponds to an area of the frame F and an inner surface corresponds to an area of the blade 170. Preferably, each step is treated with the curved surface to allow easy entry of the blade 170 and the frame F.

Since the blade 170 may be variously implemented depending on shape or seating depth, the seating portion 119 is implemented in the multistep form to correspond to the blade 170.

Further, each receiving groove 121 is a region for accommodating the corresponding elastic body 130 and preventing it from protruding outwards. The fastening holes 123 are further formed at regular intervals in a longitudinal direction to fasten ends of the elastic body 130. Here, the receiving grooves 121 and the fastening holes 123 are provided on both sides of each of the first and second guards 111 and 115 in such a way as to be symmetric with respect to each other.

These fastening holes 123 are holes into which the fastening pin 131 is fastened so as to lock the elastic body 130 to any one of the holes 123. The elastic body 130 is removably coupled along the line indicated in FIG. 3.

Preferably, the elastic body 130 comprises a coil spring. Particularly preferably, the shape of each of opposite ends of the elastic body 130 is that of a hook so as to easily pass through and be thus hooked to the fastening pin 131.

The fastening pin 131 is screwed into the corresponding fastening hole 123 as shown in FIG. 3, or may be in the form of a pin as shown in the sectional views of FIGS. 4A to 4C. It will be described with reference to the accompanying drawings.

As shown in FIGS. 4A to 4C, the fastening pin 131 includes a body 133, a head 132 provided on one end of the body 133, and a locker 135 provided on the other end of the body 133.

Preferably, the length of the body 133 corresponds to the fastening hole 123, and its diameter is equal to or less than that of the fastening hole 123. Particularly preferably, in order to easily insert the body 133 into the fastening hole 123, the diameter of the body 133 is formed to be slightly small, and the end of the body 133 having the locker 135 is imparted with a curved surface.

The head 132 is provided on one end of the body 133 to prevent the elastic body 130 from being removed from between the fastening holes 123. Preferably, the head 132 is formed to have a larger diameter than the fastening hole 123 or at least any portion of the head 132 has a larger area.

The locker 135 is joined to the other end of the body 133 via a hinge 134 to prevent the body 133 from being removed from the fastening hole 123, or to lock or unlock the opposing elastic body 130, as shown in the drawings. Here, the locker 135 rotates around the hinge 134. Preferably, the locker 135 is joined to the hinge 134 via an elongated hole 136 so as to minimize a radius of rotation.

The joining operation of the fastening pin 131 will be described in detail using the flow of FIGS. 4A to 4C.

FIG. 4A shows the state before the fastening pin 131 is joined to the fastening hole 123. After placing the elastic bodies 130 in the respective receiving grooves 121, the fastening pin 131 is inserted in the indicated direction, so that one elastic body 130 is supported between the fastening hole 123 and the head 132 as shown in FIG. 4B. In order to lock the other (that is, the opposing) elastic body 130 using the locker 135, the locker 135 is rotated as shown in FIG. 4C to lock the other elastic body 130.

Thus, each elastic body 130 is locked between the opposite ends of the fastening pin 131, that is, between the head 132 and the locker 135, so that it is possible to lock or unlock the elastic body 130 just by rotating the locker 135. As a consequence, an additional tool (e.g. a screwdriver, pincers, etc.) is not required to lock or unlock the elastic body 130, and in addition, it is easy to assemble or disassemble the elastic body 130 with or from the guard 100, and the complication and inconvenience of having to possess the tool can be overcome.

However, preferably, the fastening pin 131 is not limited to the shape shown in the drawings, but may have a resilient fastening structure as shown in FIGS. 5A to 5D and FIGS. 6A to 6C. This will be described with reference to FIGS. 5A to 5D and FIGS. 6A to 6C.

FIGS. 5A to 5D are views illustrating another example of the fastening pin in accordance with the preferred embodiment of the present invention, and FIGS. 6A to 6*c* are views illustrating the joining of the fastening pin of FIGS. 5A to 5D.

As shown in the drawings, the fastening pin 131 is resiliently fastened to the fastening hole 123 to support the elastic body 130.

That is, as shown in FIG. 5A, the elastic body 130 can be resiliently supported merely by inserting the fastening pin 131 into the fastening hole 123.

Such a fastening pin 131 has a length corresponding to the fastening hole 123, and includes a body 133 with a diameter that is equal to or less than that of the fastening hole 123, a head 132 provided on one end of the body 133, and a locker 135 resiliently joined to the fastening hole 123. This will be described with reference to FIG. 5B.

FIG. 5B is a perspective view showing the fastening pin 131 of FIG. 5A. Such a fastening pin 131 is configured so that the head 132 and the locker 135 are provided on both ends of the body 133.

The head 132 is provided on one end of the body 133, and is larger in diameter than at least the fastening hole 123, with any one elastic body 130 supported between the head 132 and the fastening hole 123.

Further, the head 132 is shaped such that any one side thereof is biased and protrudes with respect to the body 133 serving as an axis, and is further provided with a protruding portion 132-1 to more reliably support the elastic body 130 between the head 132 and the fastening hole 123. Such a protruding portion 132-1 protrudes as shown in FIG. 5C.

The locker 135 is provided on the other end of the body 133, and is resiliently locked to the fastening hole 123 to prevent the body 133 from being removed from the fastening hole 123 and also to support the other elastic body 130, thus preventing the elastic body 130 from being removed from the receiving groove 121.

Such a locker 135 includes a cut portion 137, elastic pieces 139, and locking steps 138. The cut portion 137 is formed by cutting an end of the locker 135 axially, and is larger than the diameter of the fastening hole 123. The elastic pieces 139 are symmetrically present on opposite sides of the cut portion 137. The locking step 138 is formed between each elastic piece 139 and the body 133.

The cut portion 137 allows the diameter of the elastic pieces 139 to be easily resiliently reduced or restored. Preferably, the cut portion 137 is formed to extend from the end of the locker 135 to a portion of the body 133. More particularly, the cut portion 137 has a 'V' shape that is sharp towards the body 133.

The elastic pieces 139 are formed by the cut portion 137, and are larger in diameter than the fastening hole 123. The diameter of the elastic pieces 139 can be easily resiliently reduced or restored by means of the cut portion 137.

As show in the drawings, the elastic piece 139 is preferably formed to have a sharp end. This enables the ticker 135 to be easily introduced into the fastening hole 123.

The locking steps 138 are steps formed by the elastic pieces 139 that are larger in diameter than the fastening hole 123 and the body 133 that is equal to or less in diameter than the fastening hole 123. The locking steps 138 allow the fastening pin to be resiliently fastened to the fastening hole 123, in addition to supporting the elastic body 130 between the locker 135 and the fastening hole 123.

Meanwhile, in order to prevent the locking step 123 from being worn or damaged due to frequent use of the elastic piece 139, as shown in FIG. 5D, a reinforcing member 139-1 is further provided to reinforce the thickness of a region of the elastic piece 139 adjacent to the locking step 138.

Preferably, the reinforcing member 139-1 reinforces the thickness of the region of the elastic piece 139 adjacent to the locking step 138 in such a way as to keep the end of the elastic piece 139 sharp. The joining of the fastening pin 131 will be described with reference to FIG. 6, reference numerals of respective components remaining the same as those of FIG. 5.

FIGS. 6A to 6C are views illustrating the joining of the fastening pin of FIGS. 5A to 5D.

FIG. 6A shows the state before the fastening pin 131 is joined to the fastening hole 123. After the elastic body 130 is located in the receiving groove 121, the fastening pin 131 is inserted in an indicated direction, so that one elastic body 130 is supported between the fastening hole 123 and the head 132 as shown in FIG. 6B. In this case, the diameter of the locker 135 is resiliently reduced, so that the locker 135 passes through the fastening hole 123 and subsequently passes through the other elastic body (opposite elastic body) 130 as shown in FIG. 6C. The elastic pieces 139 are restored from their compressed state, thus locking the other elastic body 130 between the locking step 138 and the fastening hole 123.

Thus, each elastic body 130 is locked between both ends of the fastening pin 131, that is, between the head 132 and the locker 135.

Figure 4:
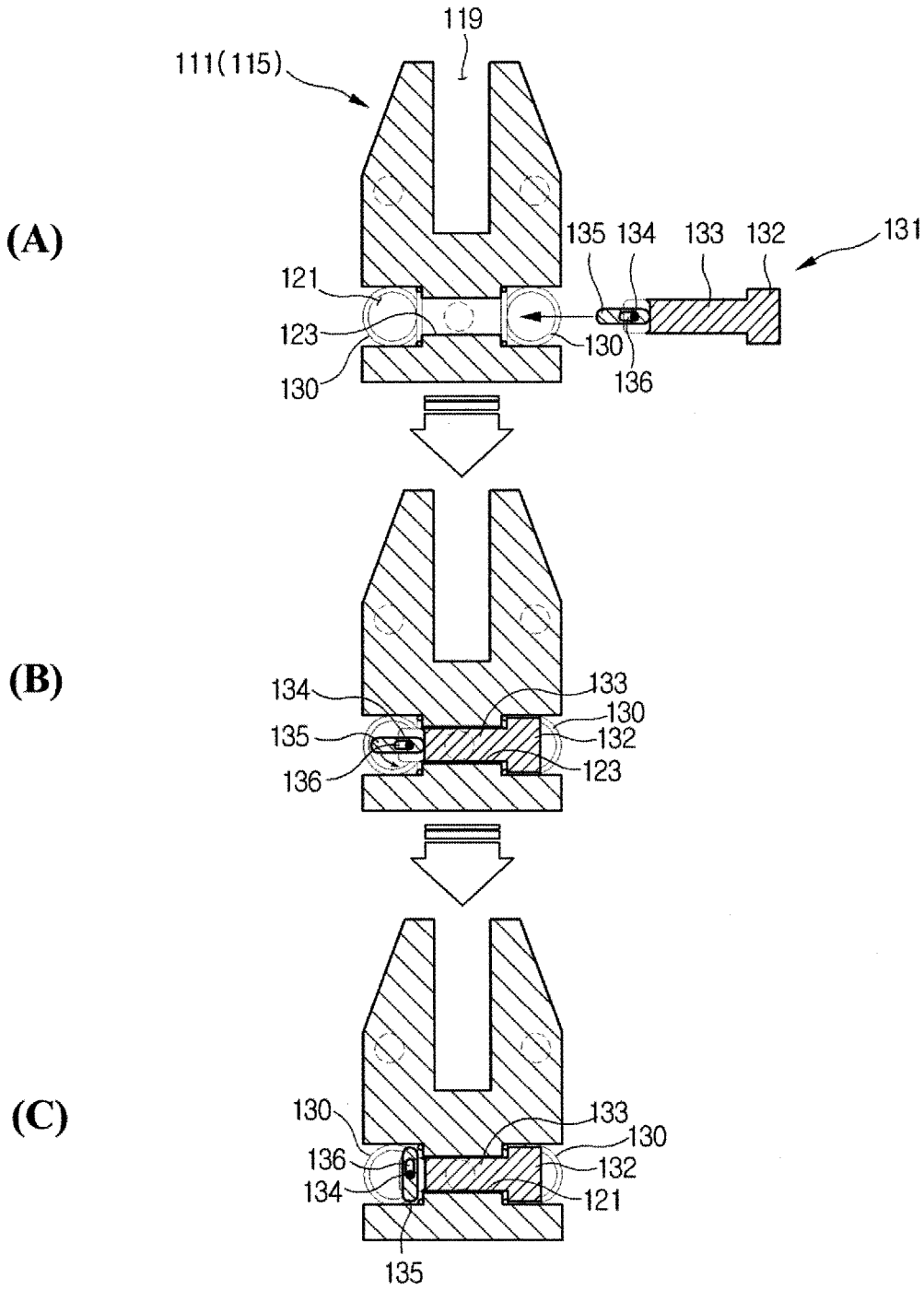
FIGS. 4A to 4C are sectional views illustrating the joining of an example of the fastening pin in accordance with the preferred embodiment of the present invention.
Figure 5:
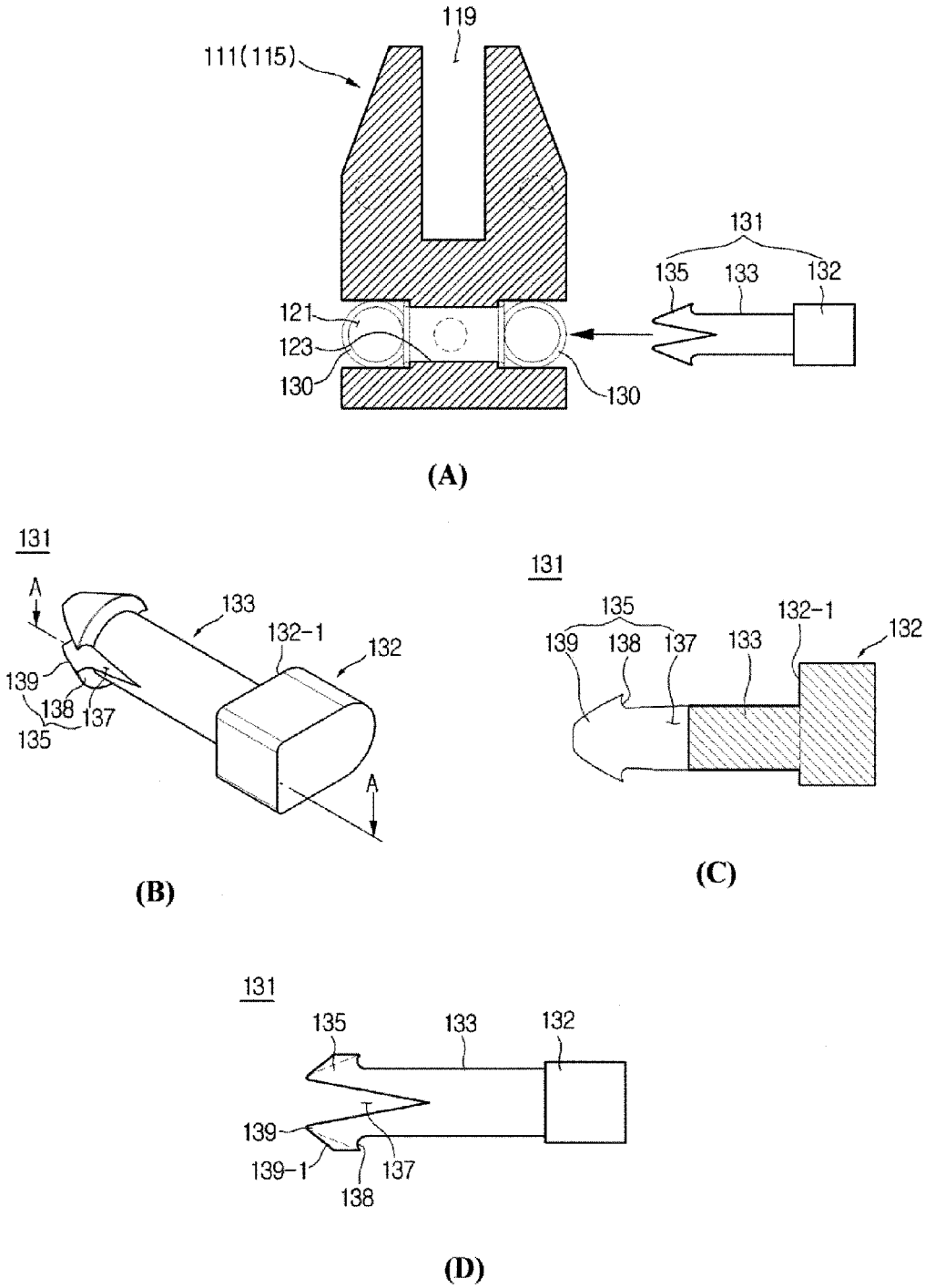
FIGS. 5A to 5D are views illustrating another example of the fastening pin in accordance with the preferred embodiment of the present invention.
Figure 6:
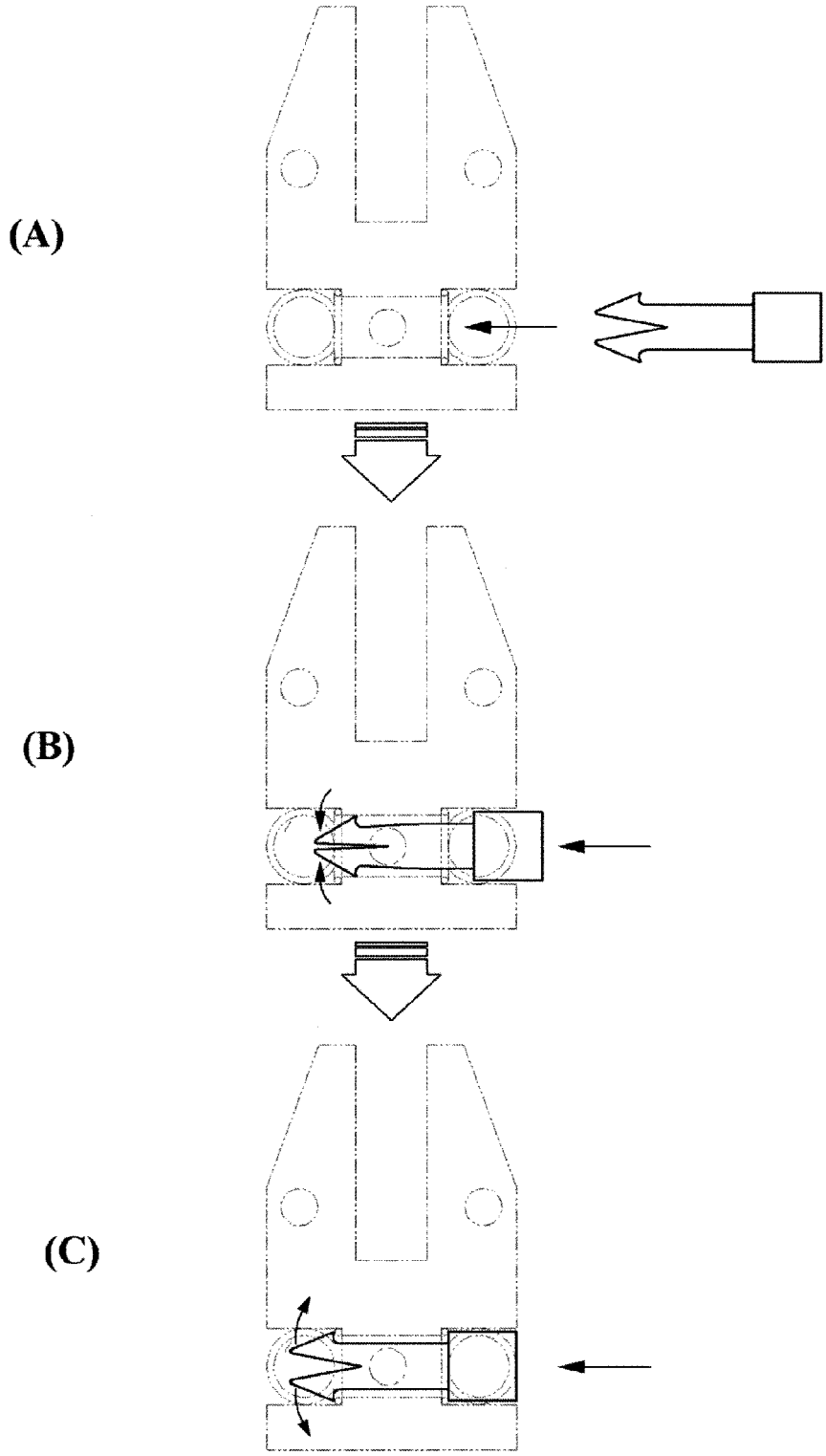
FIGS. 6A to 6*c* are views illustrating the joining of the fastening pin of FIGS. 5A to 5D.

Such a fastening pin 131 may lock or unlock the elastic body 130 merely by elastically releasing the locker 135. Accordingly, as illustrated in FIG. 4, it is possible to lock or unlock the elastic body 130 without a separate tool, and moreover it is easy to be coupled to or decoupled from the guard 100, thus eliminating the complication and inconvenience of possessing the tool.

Meanwhile, as shown in FIG. 2, the first guard 111 further includes the front end 113 surrounding the front end 171 of the skate blade 170. Such a front end 113 prevents the front end 171 from being exposed to the outside, and prevents a users body or clothing from being damaged by impact acting on the front end 171 and the exposed front end 171. The rear end of the skate blade is guarded by the rear end 117 of the second guard.

At least any one of the front end 113, the rear end 117 and the side of the guard further includes an ornament 150. The ornament 150 is preferably at least any one of a light, a logo, a name tag, initials or a character. Such an ornament 150 will be described with reference to FIG. 7.

Figure 7:
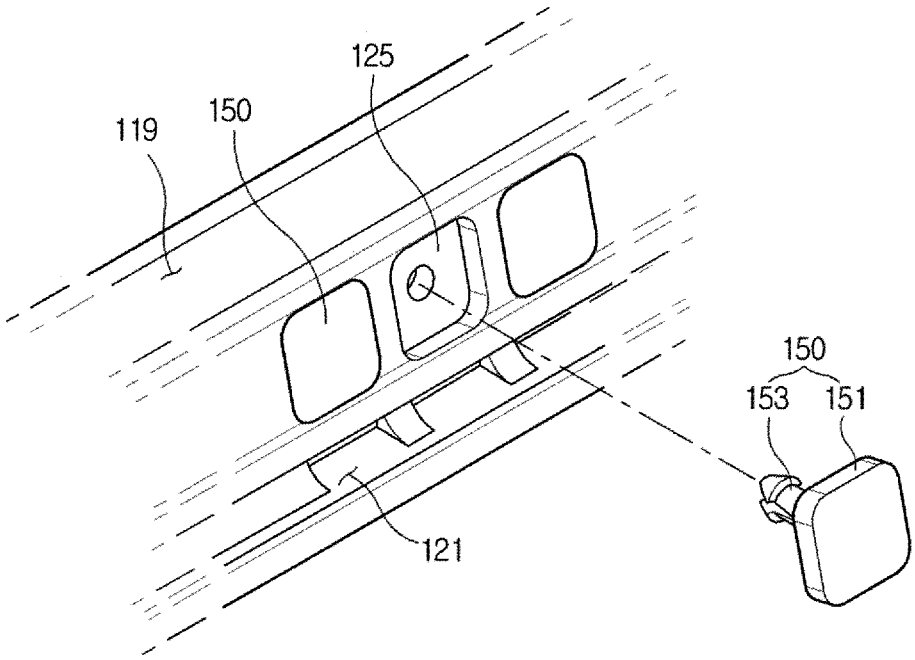
FIG. 7 is a view illustrating the coupling of an ornament in accordance with a preferred embodiment of the present invention.

FIG. 7 is a view illustrating the coupling of an ornament in accordance with a preferred embodiment of the present invention.

Referring to the drawing, the ornament 150 is detachably attached to any one of the front end 113, the rear end 117 and the side of the guard 100 as shown in FIG. 2, thus improving discrimination for the skate 160 as well as the guard 100 itself, providing a good appearance, and allowing the coupling direction of the skate blade 170, namely, a positional relation between the first guard 111 and the second guard 115, to be clearly identified. As such, the ornament 150 adds a variety of functionalities, thus satisfying consumers.

For example, if the ornament 150 is a light, the guard 100 is prevented from being lost in dark places, and discernibility can be improved at night. If the ornament 150 is the logo, the guard 100 is useful for sponsorships or sales promotion, so that business advertising effect can be expected.

Further, if the ornament 150 is a name tag or initials, individuals are easily distinguishable. If the ornament 150 is a character, it is selectively attached according to an individual's preference, so that the guard 100 has a better appearance, in addition to clarifying the distinction between a user and others' products.

Furthermore, the functions of the ornament 150 may be combined with each other, or it is possible to provide two or more functions, thus further stimulating consumer sentiment, and fulfilling expectations of the guard.

Further, the ornament 150 presents the directivity of the guard 100, namely, a positional relation between the front end 113 and the rear end 117, thus allowing the guard 100 to be more easily coupled to the skate blade 170.

Such an ornament 150 includes an ornament head 151 and an ornament fastening member 153 as shown in FIG. 7. Any one of the light, the logo, the initials, the name tag and the character is attached or carved on the ornament head 151. The ornament fastening member 153 protrudes from a surface of the ornament head 151 and is detachably fastened to the fastening hole 125 formed in the guard 100.

Preferably, the shape of the ornament head 151 is not limited to a rectangular shape that is shown in the drawing, but the shape of various figures is also possible. Although not shown in the drawing, the shape of combining English and Korean is very preferable in the case of the initials or name tag.

Figure 8:
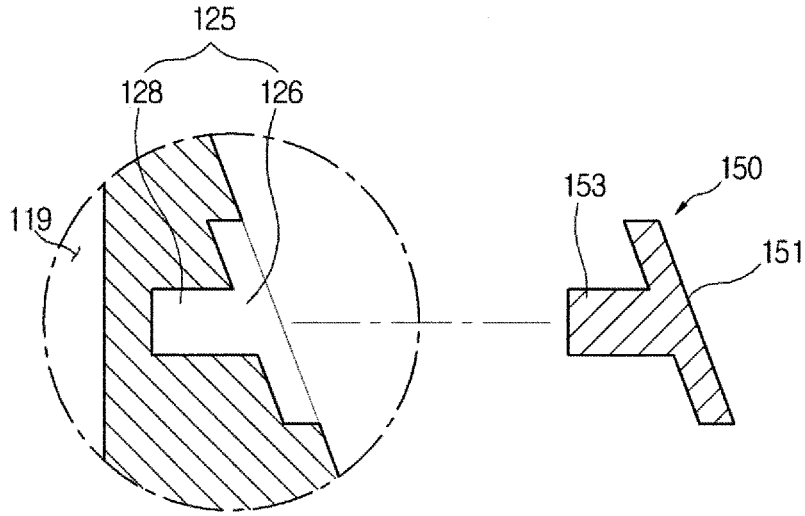
FIGS. 8A and 8B are detailed views illustrating an example of the fitting of the ornament in accordance with the preferred embodiment of the present invention.
Figure 8:
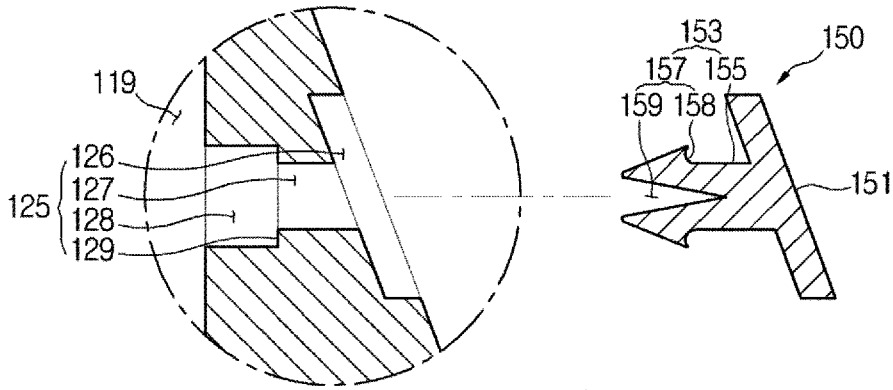

Such an ornament 150 is fitted to the fastening hole 125 through press-fitting or resilient-fitting as shown in FIGS. 8A and 8B. This will be described with reference to FIGS. 8A and 8B that show the fitting of the ornament 150 in detail.

FIGS. 8A and 8B are detailed views illustrating an example of the fitting of the ornament in accordance with the preferred embodiment of the present invention.

As shown in the drawings, the ornament 150 is detachably fitted to the fastening hole 125. FIG. 8A shows the fitting of the ornament 150 into the fastening hole 125 through press-fitting.

That is, as shown in the drawing, the diameter of the ornament fastening member 153 protruding from a surface of the ornament head 151 is equal to the diameter of a space 128 of the fastening hole 125, so that the ornament 150 is fitted into the fastening hole 125 through press-fitting.

Here, if a receiving recess 126 is present, the ornament head 151 is embedded into the fastening hole 125. Alternatively, although not shown in the drawing, if the receiving recess 126 is not present, the ornament head 151 may protrude outwards.

FIG. 8B shows the fitting of the ornament 150 into the fastening hole 125 using the ornament fastening member 153 through resilient-fitting.

Such an ornament 150 includes an ornament body 155 that corresponds to the diameter of a bore hole 127, and an ornament resilient member 157 that is provided on an end of the ornament body 155.

As shown in the drawing, the ornament resilient member 157 is larger in diameter than the ornament body 155, is shaped towards an end of the ornament 150, and is elastically present due to an ornament cut portion 159.

Further, an ornament locking step 158 is provided between the ornament body 155 and the ornament resilient member 157 due to a difference in diameter therebetween.

Since such a fastening method of the ornament 150 utilizes the resilient fitting method as in another example of the fastening pin 131 illustrated in FIGS. 6A to 6C, a detailed description thereof will be omitted.

The receiving recess 126 is the recess that is formed in intaglio to seat the ornament head 151 therein. The bore hole 127 is the hole through which the ornament fastening member 153, that is, the ornament body 155 and the ornament resilient member 157 pass. The space 128 is the region that receives the ornament resilient member 157, is larger in diameter than the bore hole 127, and prevents the ornament resilient member 157 from protruding to the seating portion 119.

Further, a locking-step support 129 is a step formed by a difference in diameter between the bore hole 127 and the space 128, thus supporting the ornament locking step 158 and preventing undesirable removal of the ornament 150.

Meanwhile, the extension block 140 for extending the length of the guard 100 is selectively coupled between the first guard 111 and the second guard 115, thus compensating for a length by which it is deficient when the guard 100 is shorter than the skate blade 170.

The extension block 140 has a shape corresponding to the first guard 111 and the second guard 115. Preferably, the seating portion 119 and the receiving grooves 121 are formed, respectively, in the extension block 140.

In this connection, the receiving groove 121 has the shape of a hole as shown in FIG. 3, thus preventing the extension block 140 from being removed from the guard 100, and preventing the elastic body 130 from protruding out from a region of at least the extension block 140.

As shown in the drawings, such an extension block 140 is assembled as follows: after the elastic body 130 has been coupled with the extension block 140, the elastic body 130 is joined to each of the first and second guards 111 and 115. Thereby, the installation of the extension block 140 and the assembly of the guard 100 can be completed at the same time.

Meanwhile, the extension block 140 comprises at least one or more blocks so as to be extensible depending on the length of the skate blade 170 when the extension block 140 makes up for the deficient length of the guard 100.

In other words, when it is required to extend the length of the guard 100 because the skate blade 170 is longer than the guard 100, at least one extension block 140 or a desired number of extension blocks 140 corresponding to the desired length is added between the first guard 111 and the second guard 115, thus maintaining a length corresponding to the skate blade 170.

Assuming that the guard 100 is 200 mm in length and the skate blade 170 is 230 mm in length, the first guard 111 and the second guard 115 are spaced apart from each other by a deficient length, 30 mm or more, and then three extension blocks 140 having the length of 10 mm or one extension block 140 having the length of 30 mm is added, thus making up for the deficient length of the guard 100.

That is, the minimum length unit of the extension block 140 ranges from 10 mm to 30 mm. If it is 10 mm, three extension blocks 140 are added to compensate for the deficient length; alternatively, if it is 30 mm, one extension block 140 is added to compensate for the deficient length. Thereafter, the first guard 111 and the second guard 115 of the guard 100, which are provided on opposite sides of the extension block 140, are brought into close contact with each other using the restoring force of the elastic body 130, thus maintaining its extended state.

However, the length unit of the extension block 140 is provided only as an example, and preferably is not limited to the above-mentioned length. Particularly preferably, the length unit is 5 mm or more, that is, a length corresponding to the deficient length.

Figure 9:
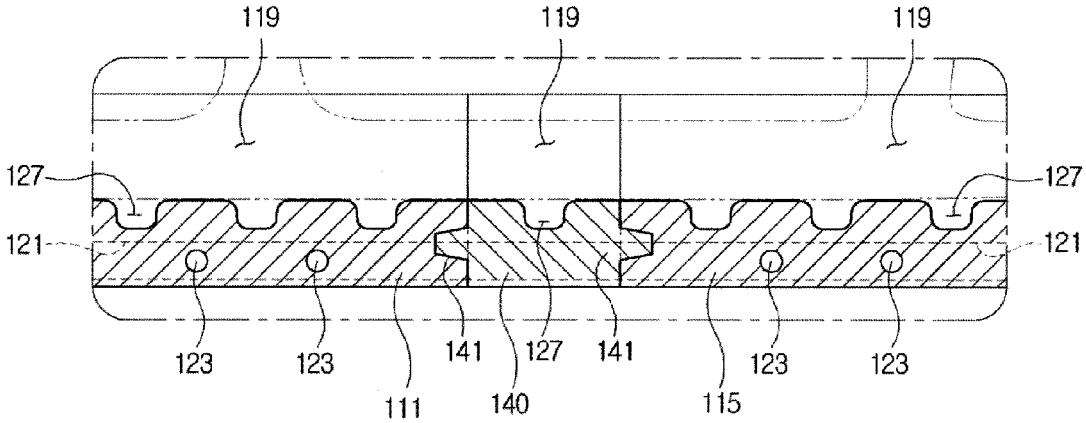
Figure 9:
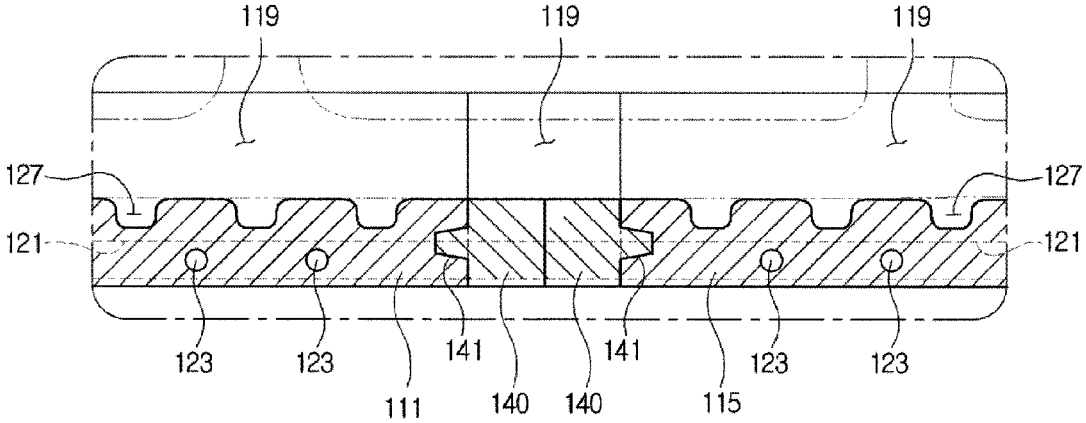

Meanwhile, as shown in FIGS. 9A and 9B, the first and second guards 111 and 115 and the extension block 140 further include coupling members 141. The coupling members 141 serve to maintain the coupling of the first guard 111 with the second guard 115, and to maintain better coupling of the extension block 140 with the first and second guards 111 and 115 when the extension block 140 is added. Here, FIG. 9A shows a case where only one extension block 140 is provided, and FIG. 9B shows a case where two extension blocks 140 are provided. In the event that the two extension blocks 140 are provided, the coupling members 141 are preferably configured so that they do not form a coupling to the extension blocks 140 but are coupled to the first guard 111 and the second guard 115, respectively. In the event that three or more extension blocks 140 are provided, the coupling members 141 of a middle extension block 140 may be coupled to holes of any one of the extension blocks 140 adjacent to both sides of the middle extension block 140. If the coupling members 141 are detachable, they may be located between both the extension blocks 140.

Figure 11:
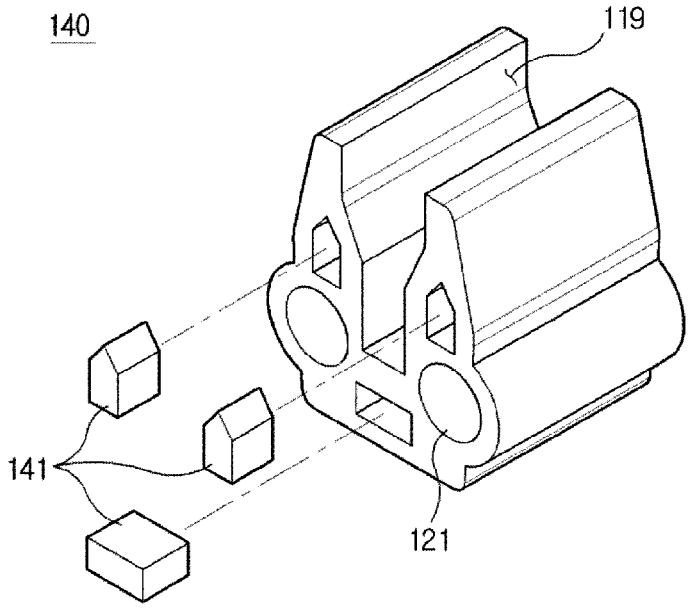
FIGS. 11A and 11B are perspective views illustrating a coupling member in accordance with a preferred embodiment of the present invention.
Figure 11:
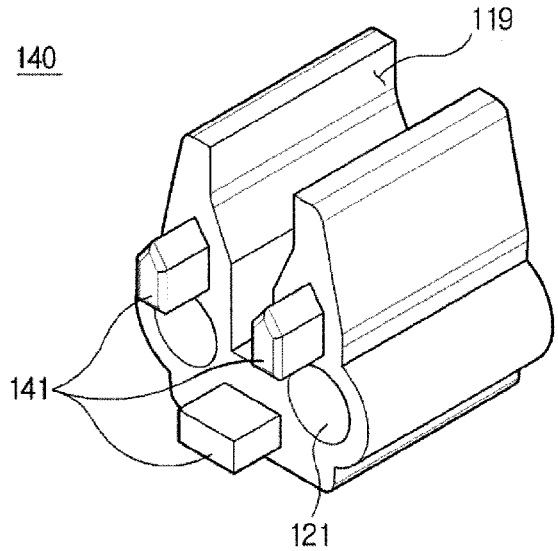

The coupling member 141 according to an embodiment of the present invention may be detachably provided on the extension block 140 as shown in FIG. 11A, or may be integrated with the extension block 140 as shown in FIG. 11B.

If such a coupling member 141 is detachable as shown in FIG. 11A, the coupling member 141 is fastened to the hole through press-fitting. Further, if the coupling member 141 has the shape of a cylindrical rod (not shown), threads may be formed thereon, so that the coupling member 141 is fastened through a screw-type fastening method. Other fastening methods are possible.

Meanwhile, the extension block 140 is present in various shapes and forms. This will be described with reference to FIGS. 12A to 12D.

FIGS. 12A to 12D are front views illustrating an example of the extension block in accordance with a preferred embodiment of the present invention.

Figure 12:
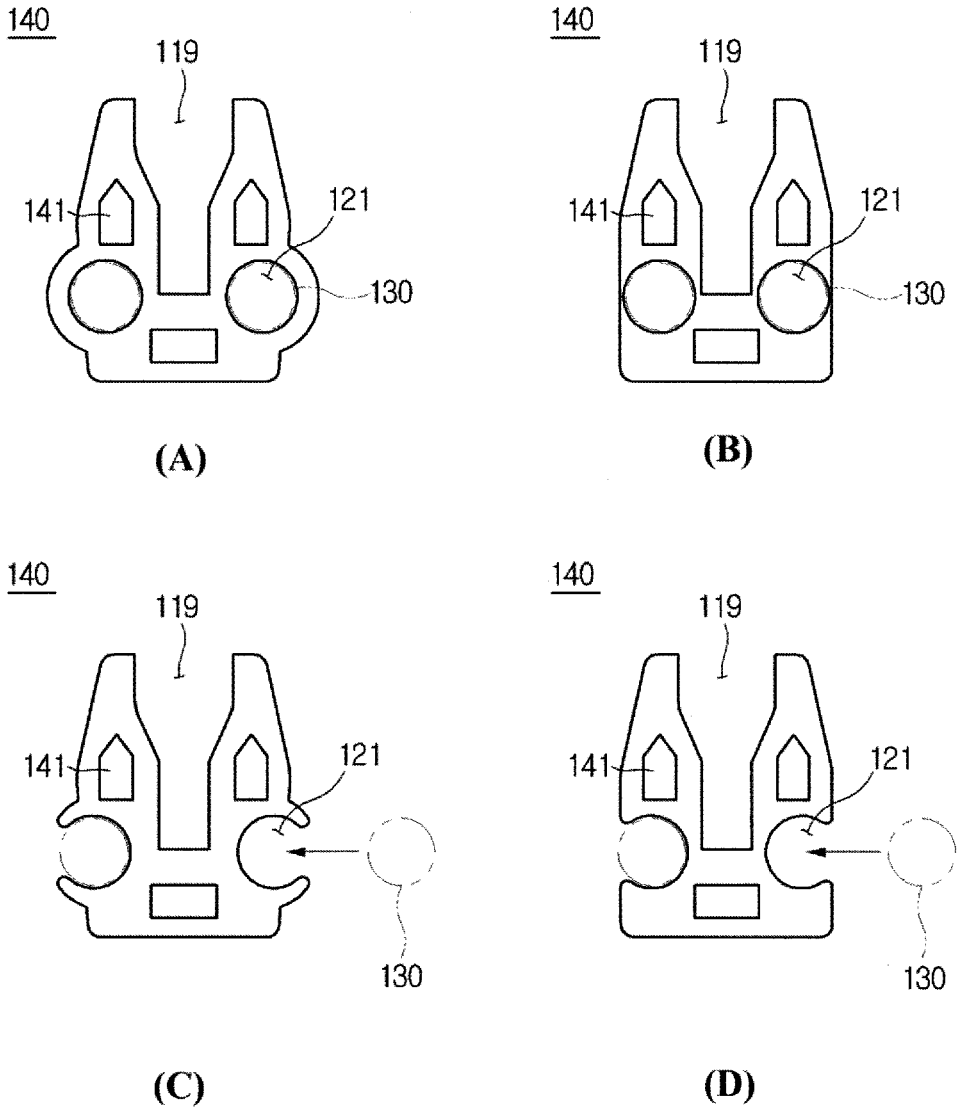
FIGS. 12A to 12D are front views illustrating an example of an extension block in accordance with a preferred embodiment of the present invention.

The receiving grooves 121 are present in a closed form as shown in FIGS. 12A and 12B, or present in an open form as shown in FIGS. 12C and 12D.

FIG. 12A shows an example where the receiving grooves 121 are provided in the closed form. Portions of the extension block 140 corresponding to the receiving grooves 121 protrude to both sides. Specifically, in order to cope with the space of the extension block 140 in which the receiving grooves 121 are formed, or with the size of the elastic bodies 130, the extension block 140 protrudes to both sides.

However, this is not the protruding simply defining the space, but naturally serves to improve an entire balance with the guard 100 and to provide an esthetic appearance in terms of design, as shown in FIG. 1.

FIG. 12B shows an example where portions of the extension block 140 corresponding to the receiving grooves 121 are flat. This is configured in consideration of the space utilization of the elastic bodies 130 or the receiving grooves 121 and an entire balance with the guard 100.

Further, FIG. 12C is similar to FIG. 12A, but is open. A side of each receiving groove 121 is open to enable the elastic body 130 to be put in the receiving groove 121 through the side thereof. The extension block 140 is preferably made of synthetic resin having resilient flexibility. FIG. 12D is similar to FIG. 12B, but is open. The extension block 140 of FIG. 12D very preferably has the same purpose and material as that of FIG. 12C.

Figure 13:
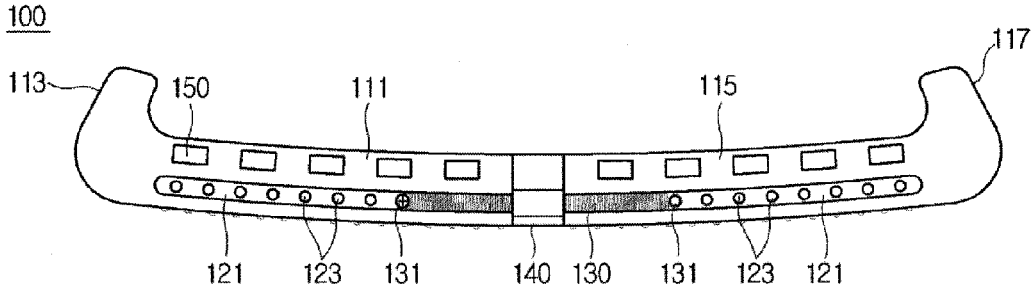
FIG. 13 is a side view illustrating a guard in accordance with another preferred embodiment of the present invention.

FIG. 13 shows a guard in accordance with another preferred embodiment of the present invention.

As shown in the drawing, the guard of the present invention is configured so that at least a lower surface of each of the first and second guards 111 and 115 and, if necessary, the extension block 140 is curved from one end to the other end. The reason why such a configuration is used is because a lower surface of the skate blade is substantially curved. Meanwhile, inner surfaces of the guards 111 and 115 and, if necessary, of the extension block 140 may be curved to correspond to the curved shape of the skate blade.

Practically, the lower surface of the skate blade is manufactured based on the curvature of a circle having a radius of 24 m from one end of the skate blade to the other end. Thus, if the guard is formed in a straight line from one end to the other end and a user walks with the guard on, the guard that is relatively weaker in strength than the skate blade becomes gradually curved over time, thus deforming or damaging the guard. Further, when the user first walks with the straight line type guard on, the guard does not match with the skate blade, and the rear end of the skate blade tends to be gradually spaced apart from the skate blade. Thereby, when the user walks with the guard on, he or she feels uncomfortable.

Therefore, as in the present invention, if the guard is manufactured to have a curvature corresponding to that of the skate blade from one end to the other end thereof, a user does not feel uncomfortable even when walking, and the deformation of and damage to the guard is prevented, so that the guard can be used for a lengthy period of time.

As described above, although reference to the embodiments has allowed the present invention to be described in more detail, it should be understood that the present invention is not limited to the embodiments but may be variously changed without departing from the technical idea of the present invention. Therefore, the embodiments disclosed in the present invention are not restrictive but are illustrative, and the scope of the technical idea of the present invention is not limited to the embodiments. The scope of the present invention should be interpreted by the accompanying claims, and it is to be understood that all technical ideas within the claims fall within the purview of the present invention.

What is claimed is:

1. A length adjustable skate blade guard, comprising:

a first guard surrounding at least a portion of a lower surface of a skate blade and a front end of the skate blade;

a second guard surrounding a remaining portion of the lower surface of the skate blade and a rear end of the skate blade;

at least one extension block coupled between the first guard and the second guard, and extending a length of the guard to correspond to a length of the skate blade; and at least one elastic body secured at opposite ends thereof to the first guard and the second guard, respectively, the elastic body elastically putting the facing first and second guards in close contact with each other, wherein each of the first and second guards comprises:

a first seating portion surrounding the skate blade;

a first receiving groove longitudinally provided in an outer portion thereof to receive the elastic body; and one or more fastening holes provided at regular intervals in a longitudinal direction of the first receiving groove, with a fastening pin being fitted into a corresponding fastening hole to fasten the elastic body, wherein the extension block comprises a second seating portion and a second receiving groove extending therein, the second receiving groove comprising a hole that has a shape corresponding to the elastic body.

2. The length adjustable skate blade guard as set forth in claim 1, wherein the fastening pin comprises:

a body having a length that corresponds to that of the fastening hole, a diameter of the body being smaller than or equal to that of the fastening hole;

a head provided on an end of the body and having a larger diameter than the fastening hole, with the elastic body being supported between the head and the fastening hole; and a locker coupled to an opposite end of the body via a hinge, the locker locking the elastic body and preventing the body from being removed from the fastening hole.

3. The length adjustable skate blade guard as set forth in claim 1, wherein the fastening pin comprises:

a body having a length that corresponds to that of the fastening hole, a diameter of the body being equal to or smaller than that of the fastening hole;

a head provided on an end of the body and having a larger area than the fastening hole, with the elastic body being supported between the head and the fastening hole; and a locker provided on an opposite end of the body to be resiliently coupled to the fastening hole, thus preventing the body from being removed from the fastening hole.

4. The length adjustable skate blade guard as set forth in claim 3, wherein the locker comprises:

a cut portion formed by cutting an end of the locker axially, the cut portion being larger than the diameter of the fastening hole;

elastic pieces symmetrically provided on opposite sides of the cut portion; and a locking step formed between each of the elastic piece and the body of the locker.

5. The length adjustable skate blade guard as set forth in claim 4, wherein each of the elastic pieces further comprises:

a reinforcing member formed to be sharp at an end thereof, and reinforcing a thickness of a region of the elastic piece adjacent to the locking step.

6. The length adjustable skate blade guard as set forth in claim 3, wherein the head is biased and protrudes with respect to the body serving as an axis, and further comprises a protruding portion to support the elastic body between the head and the fastening hole.

7. The length adjustable skate blade guard as set forth in claim 1, wherein the first and second seating portions are in a form of a multistep to receive both the blade and a frame supporting the blade.

8. The length adjustable skate blade guard as set forth in claim 1, further comprising:

an ornament detachably attached to at least one of a front end of the guard surrounding the front end of the skate blade, a rear end of the guard surrounding the rear end of the skate blade, and both sides of the guard.

9. The length adjustable skate blade guard as set forth in claim 8, wherein the ornament comprises any one of a light, a logo, initials, a name tag, and a character, or is present as an indicator for indicating a coupling direction of the skate blade.

10. The length adjustable skate blade guard as set forth in claim 9, wherein the ornament comprises:

an ornament head, with any one of the light, the logo, the initials, the name tag and the character being attached or carved on the ornament head; and an ornament fastening member protruding from a surface of the ornament head, and detachably fastened to the fastening hole formed in the guard through press-fitting or resilient-fitting.

11. The length adjustable skate blade guard as set forth in claim 10, wherein the ornament fastening member comprises:

an ornament body passing through the fastening hole; and an ornament resilient member provided on an end of the ornament body, and resiliently detachably fastened to the fastening hole.

12. The length adjustable skate blade guard as set forth in claim 8, wherein the ornament comprises:

an ornament head, with any one of the light, the logo, the initials, the name tag and the character being attached or carved on the ornament head; and an ornament fastening member protruding from a surface of the ornament head, and detachably fastened to the fastening hole formed in the guard through press-fitting or resilient-fitting.

13. The length adjustable skate blade guard as set forth in claim 12, wherein the ornament fastening member comprises:

an ornament body passing through the fastening hole; and an ornament resilient member provided on an end of the ornament body, and resiliently detachably fastened to the fastening hole.

14. The length adjustable skate blade guard as set forth in claim 1, wherein a lower surface of the first guard and the second guard, or of the first guard, the second guard and the extension block is curved from an end to an opposite end thereof.

* * * * *